US005548963A

United States Patent [19]

Skertic

[11] Patent Number: 5,548,963

[45] Date of Patent: Aug. 27, 1996

[54] JOULE-THOMPSON CRYOSTAT FOR USE WITH MULTIPLE COOLANTS

[75] Inventor: Matthew M. Skertic, Chatsworth, Calif.

[73] Assignee: Hughes Missile Systems Company, Los Angeles, Calif.

[21] Appl. No.: 486,441

[22] Filed: Jun. 8, 1995

[51] Int. Cl.[6] ..... F25B 19/02

[52] U.S. Cl. ..... 62/51.2; 244/3.16; 250/352

[58] Field of Search ..... 62/51.2; 244/3.16; 250/352

[56] References Cited

U.S. PATENT DOCUMENTS

| | | | |
|---|---|---|---|
| 3,269,140 | 8/1966 | Peterson et al. | 62/51.2 X |
| 3,413,819 | 12/1968 | Hansen | 62/51.2 X |
| 3,640,091 | 2/1972 | Buller et al. | 62/51.2 |
| 3,827,252 | 8/1974 | Chovet et al. | 62/51.2 X |
| 4,056,745 | 11/1977 | Eckels | 62/51.2 X |
| 4,570,457 | 2/1986 | Campbell | 62/51.2 |
| 5,003,783 | 4/1991 | Keale | 62/51.2 |
| 5,077,979 | 1/1992 | Skertic et al. | 62/51.2 |
| 5,357,759 | 10/1994 | Segev et al. | 62/51.2 |

FOREIGN PATENT DOCUMENTS

| | | | |
|---|---|---|---|
| 0582817 | 2/1994 | European Pat. Off. | 62/51.2 |
| 4235752 | 4/1994 | Germany | 62/51.2 |
| 4235757 | 4/1994 | Germany | 62/51.2 |
| 6117715 | 4/1994 | Japan | 62/51.1 |

*Primary Examiner*—Christopher Kilner
*Attorney, Agent, or Firm*—Charles D. Brown; Randall M. Heald; Wanda K. Denson-Low

[57] ABSTRACT

A demand-flow Joule-Thomson cryostat 10' adapted for use with multiple coolants uses a replaceable coolant supply reservoir 21' to fill a coolant flow control bellows 17' within the cryostat with the same coolant used to provide refrigeration to the thermal load 15'. Upon termination of the cooling cycle, the bellows 17' is drained of coolant and thus prepared for operation from a different coolant supply 21' that may contain a different cryogen.

10 Claims, 3 Drawing Sheets

JOULE-THOMPSON CRYOSTAT FOR USE WITH MULTIPLE COOLANTS

BACKGROUND OF THE INVENTION

1. Field of the Invention

The present invention relates to Joule-Thomson effect cryostats. More specifically, the present invention relates to apparatus for adapting a demand flow Joule-Thomson cryostat for use with a multiplicity of coolants having different cryogenic operational parameters.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art:

A cryostat is an apparatus which provides a localized low-temperature environment in which operations or measurements may be carried out under controlled temperature conditions. Cryostats are used to provide cooling of infrared detectors in guided missiles, for example, where detectors and associated electronic components are often crowded into a small containment package. Cryostats are also used in superconductor systems where controlled very low temperatures are required for superconductive activity.

A Joule-Thomson cryostat is a cooling device that uses a valve (known in the art as a "Joule-Thomson valve") through which a high pressure gas is allowed to expand via an irreversible throttling process in which enthalpy is conserved, resulting in lowering of its temperature.

In conventional demand-flow Joule-Thomson cryostats, a spring-loaded, precharged, gas-filled bellows thermostat attached to a Joule-Thomson needle valve is used to meter gas throughput and refrigeration power. The bellows thermostat, which responds to cryogenic temperature, is designed to operate in the steady-state mode such that the metered gas throughput and refrigeration power is just sufficient to meet the cooling thermal load. The cryogenic temperature at which the bellows thermostat operates nominally is the design set temperature. System performance is dependent upon the specific cryogen in use during any single operation. If a substitute coolant, with a different boiling temperature, is used in place of that for which the bellows thermal contraction link is designed, the cryostat will seek a temperature that is different from the design set temperature and will consequently operate in a non-optimal manner and may even fail repeatedly.

Thus, there is a need in the art for a cryostat which provides accurate refrigeration to the thermal load using a variety of coolant gases.

SUMMARY OF THE INVENTION

The need in the art is addressed by the present invention which provides an apparatus for filling and bleeding a bellows in a Joule-Thomson cryostat system, having a Joule-Thomson cryostat connected to a coolant reservoir by a coolant supply line and a coupling for the coolant supply line to the reservoir including a controllable on-off device. The apparatus includes a mechanism for diverting coolant from the coolant supply line to and from the bellows and a mechanism for controlling flow of coolant to and from the bellows.

In operation, during a cooling cycle, the bellows internal chamber of the bellows thermostat device is coupled to the reservoir and filled with coolant from the reservoir. After termination of the cooling cycle, the device allows bleeding the coolant from the bellows, whereby the bellows is prepared for adaptive use with a replacement reservoir. In the preferred embodiment, the pressure level of coolant within the bellows is controlled during the step of filling the bellows.

The invention provides a single Joule-Thomson cryostat that functions with multiple cooling gases to provide high initial rates of cryogen flow for rapid cool-down. The inventive cryostat then switches to stable, self-regulated cryogen flow which matches the cooling load during steady state operation.

DESCRIPTION OF THE INVENTION

Figure 1:
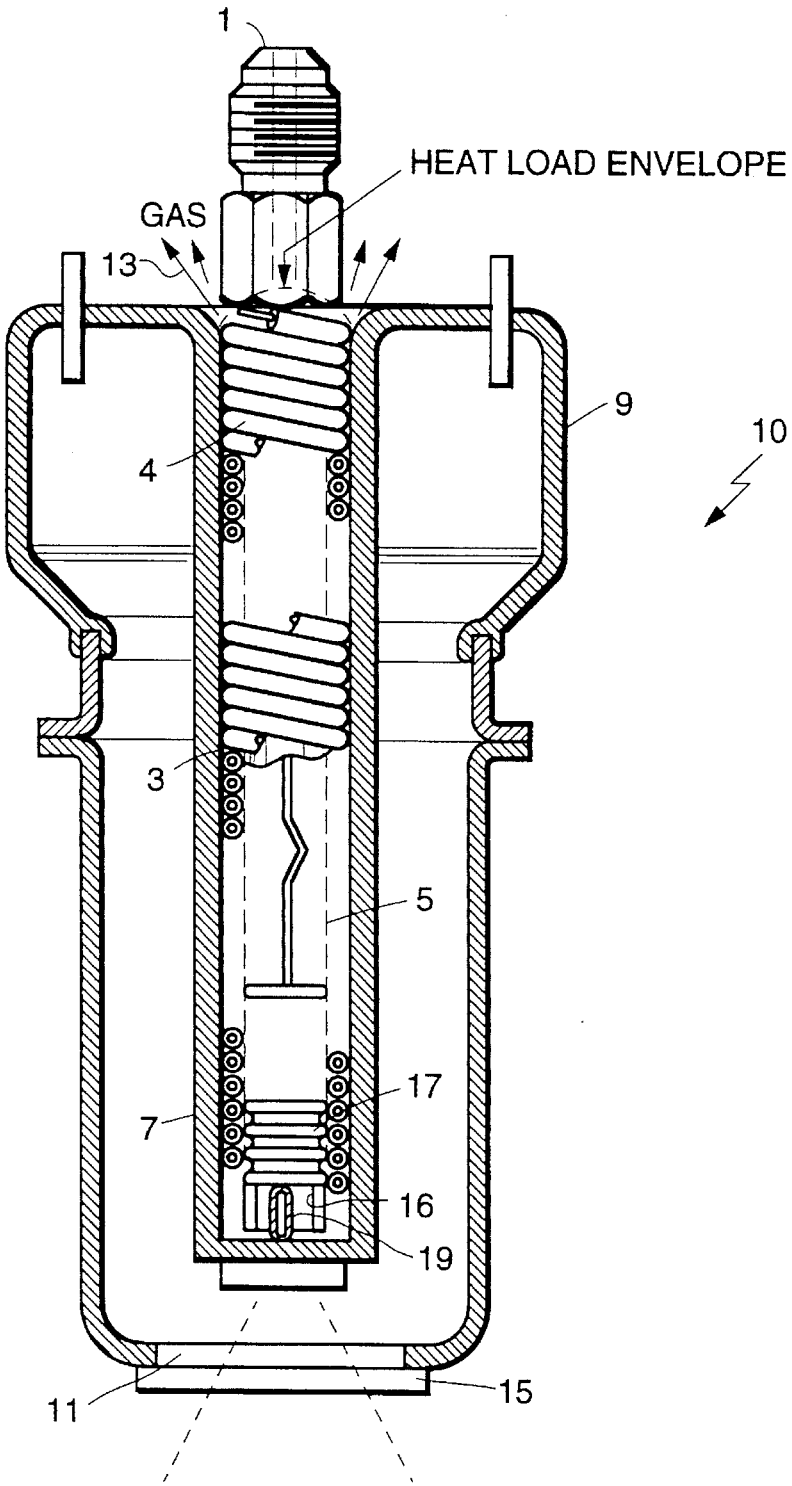
FIG. 1. ( PRIOR ART )
FIG. 1 is a schematic diagram and cross-sectional, plan view (side) of a typical conventional cryostat.

A typical conventional demand-flow Joule-Thomson cryostat 10 is shown in FIG. 1. A coolant, such as high pressure argon or nitrogen gas or even air, is introduced from a supply 21 and an on-off valve 25 through a gas inlet fitting 1 into a recuperative heat exchanger 3 that encompasses a support mandrel 5 inside a cold finger section 7 of a dewar package 9. The heat exchanger 3 basically comprises heat exchanger metal tubing 4 wrapped around the mandrel 5, that allows the high pressure gas to cool significantly as it moves toward the lower end of the cold finger section 7. The heat exchanger tubing 4 terminates in an orifice 16 at the lower end of the mandrel 5, commonly referred to as the cold end of the cryostat. The orifice 16 acts as a Joule-Thomson gas throttling valve. As the gas passes through the orifice 16 and enters the surrounding gas plenum chamber 28, it expands to a low pressure gas and creates a liquid form. The evaporated liquid and low pressure gas are used to cool the thermal load 15 which is in thermal contact with the coolant. The cooling of the load is accomplished by a liquid coolant spray from the orifice 16 onto the thermal load 15 via the dewar window 11. The dewar window 11 lets infrared radiation from the target scene into the dewar where it is sensed by the load 15 such as a detector. The coolant spray impacts the dewar coldwell endcap 18. The main thermal load is adhesively bonded to the other side of the dewar coldwell endcap 18 and cools by thermal conduction. The main thermal load 15 is in the vacuum side of the dewar and is not in direct contact with the coolant. The gas from the chamber 28 is recycled through a low pressure branch of the heat exchanger 3 before exiting into the atmosphere through exit port 13 at the upper, or warm end, of the cryostat 10. The other low pressure branch of the heat exchanger 3 is the return path through the labyrinth of fins attached to the heat exchanger tubing 4. It is bounded by the cold finger section 7 and the cryostat mandrel 5.

Demand-flow Joule-Thomson cryostats as shown in FIG. 1 have been designed with a built-in thermostatic control mechanism consisting of a gas filled bulb 38 connected to a bellows 17 which extends to the extreme cold end or bottom of the cold finger section 7. The gas bulb 38 is a tubular appendage which is connected and open to the bellow chamber. In accordance with conventional teachings, the bulb 38 is a portion of the tubing that is used to fill the bellows with gas. After the bellows is filled with gas, the tube is pinched off and forms the gas bulb. Its other function is to act as a thermal probe into the plenum chamber region where the liquefied coolant collects. The gas temperature and pressure inside the bulb responds to the surrounding thermal environment and by virtue of its direct connection to the bellows chamber, it influences the gas pressure inside the bellows.

The cooling effect is proportional to the mass flow rate of gas through the cryostat. The flow control bellows mechanism 17 within the mandrel 5 is used to provide self-regulation of the cryostat based upon the temperature within the plenum chamber 28 of the cold end. The bellows 17 is typically a sealed unit which is gas-filled. The bellows 17 is coupled to a demand-flow needle valve 19 controlling the gas flow through the heat exchanger 3 orifice 16 into the plenum chamber 28 of the cold end. As the temperature in the plenum chamber 28 drops, the temperature and pressure of the gas inside the bellows will also be affected, moving the bellows and causing the needle to extend into the Joule-Thompson orifice.

At a predetermined critical temperature, the bellows mechanism 17 will entirely close the orifice 16 of the demand-flow needle valve 19. As the temperature rises, the bellows 17 again actuates the needle valve 19, allowing new coolant flow through the orifice from the heat exchanger 3 into the plenum chamber 28 as a liquid coolant spray onto the thermal load 15.

While this type of self-regulating thermostat, demand-flow needle-valve mechanism provides some control over the refrigeration function of the cryostat, there are still limitations which can make it unacceptable in systems where temperature fluctuations can be critical to operations.

Generally, the gas bellows is filled with a specific type gas at a condensation pressure tailored to the boiling temperature of the specific design coolant to be supplied to the cryostat during a refrigeration cycle. A cryostat intended for cooling using nitrogen gas has a different bellows gas charge than a cryostat intended for use with argon gas. The same cryostat is not intended to be interchangeable with both coolants and will react differently using the different cryogens. For example, a conventional cryostat may be designed to provide a refrigeration operation temperature of 77 degrees Kelvin using nitrogen gas. If the same cryostat is used with argon gas at 87 degrees Kelvin, the gas bellows thermostat would sense that the temperature is too high and try to compensate by keeping the needle valve open. Conversely, an argon cryostat used with nitrogen gas would sense overcooling and try to shut down the needle valve, resulting in interrupted cooling before the thermal load specified operating temperature is achieved. The extent to which the behavior takes place depends on the specific location of the gas filled bulb 38 relative to the coolant.

Thus, the system performance will be dependent upon the specific cryogen in use during any single operation. If a substitute coolant is used in place of that for which the thermal contraction link is designed, the cryostat will seek the design set temperature and therefore operate non-optimally and may even repeatedly fail.

Thus, as mentioned above, a need exists in the art for a cryostat which provides accurate refrigeration to the thermal load using a variety of coolant gases.

As discussed more fully below, the present invention addresses this need by providing an apparatus for filling and bleeding a bellows in a Joule-Thomson cryostat system, having a Joule-Thomson cryostat connected to a coolant reservoir by a coolant supply line and a coupling for the coolant supply line to the reservoir including a controllable on-off device. The apparatus includes a mechanism for diverting coolant from the coolant supply line to and from the bellows, and a mechanism for controlling flow of coolant to and from the bellows.

Figure 2:
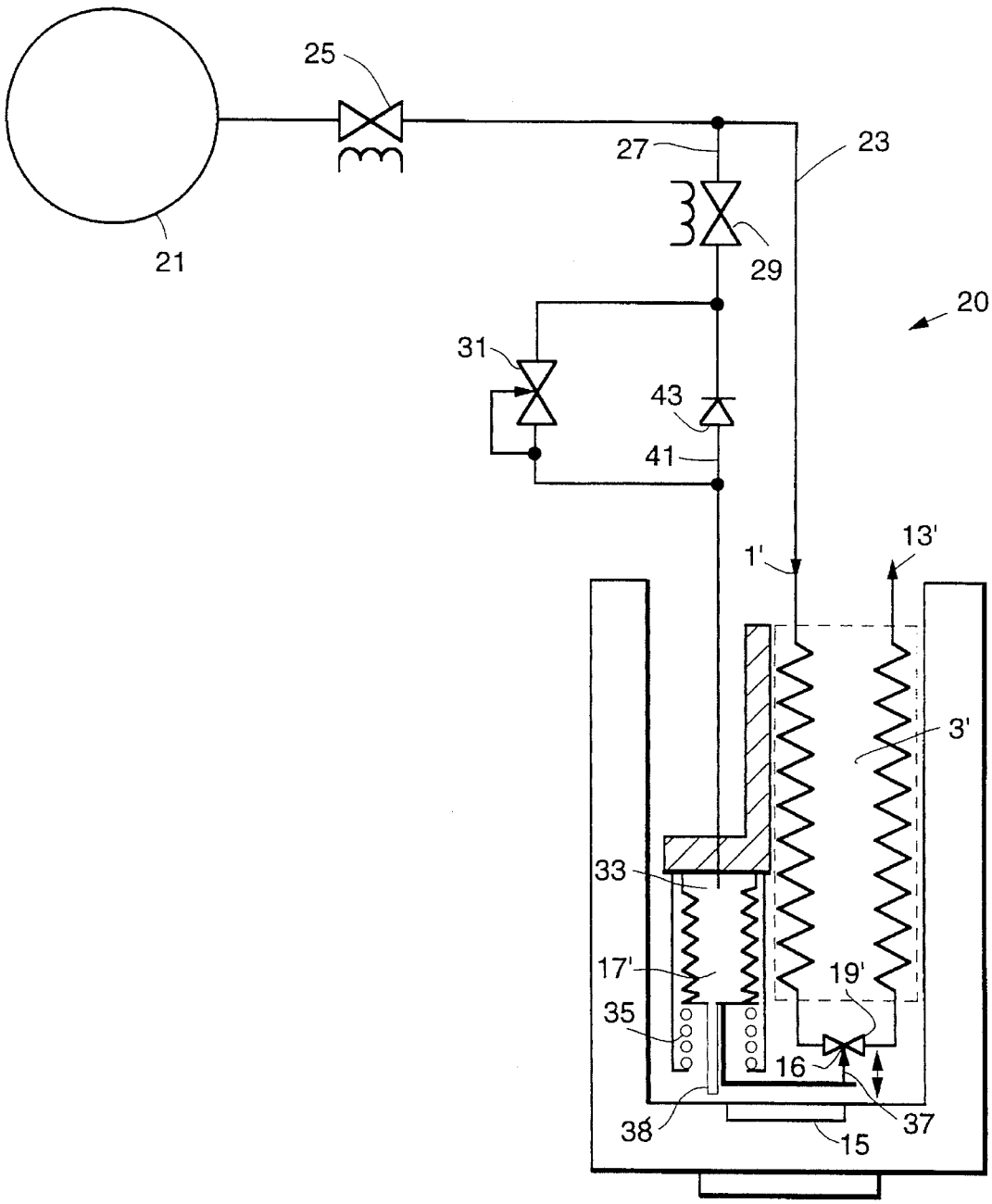
FIG. 2 is a schematic diagram and a cross-sectional plan view (side) of the cryostat of the present invention.
Figure 3A:
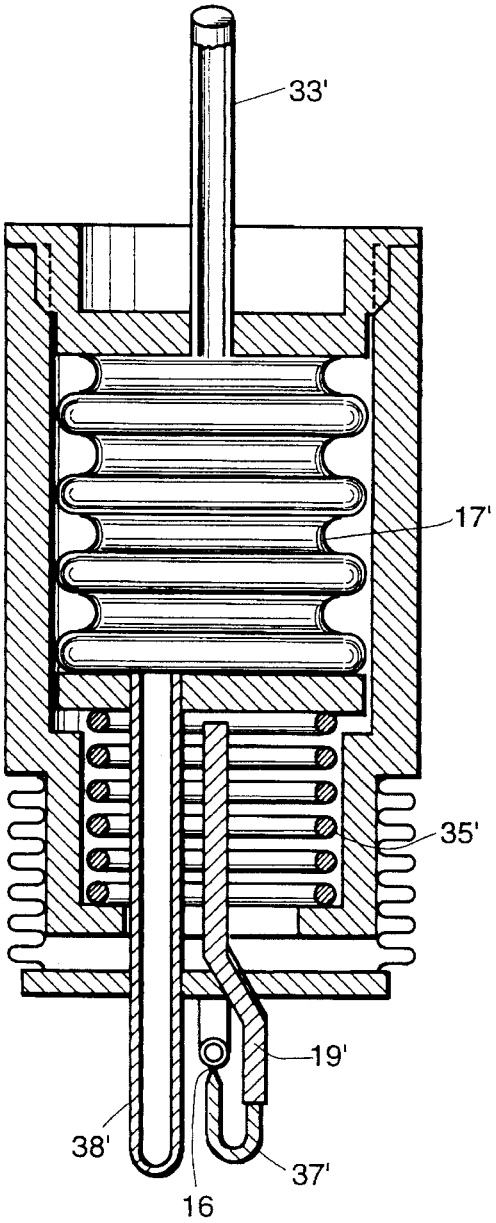
FIG. 3*a* is an expanded, cross-sectional, plan view (side) of the bellows thermostat and Joule-Thomson needle valve in the open position.
Figure 3B:
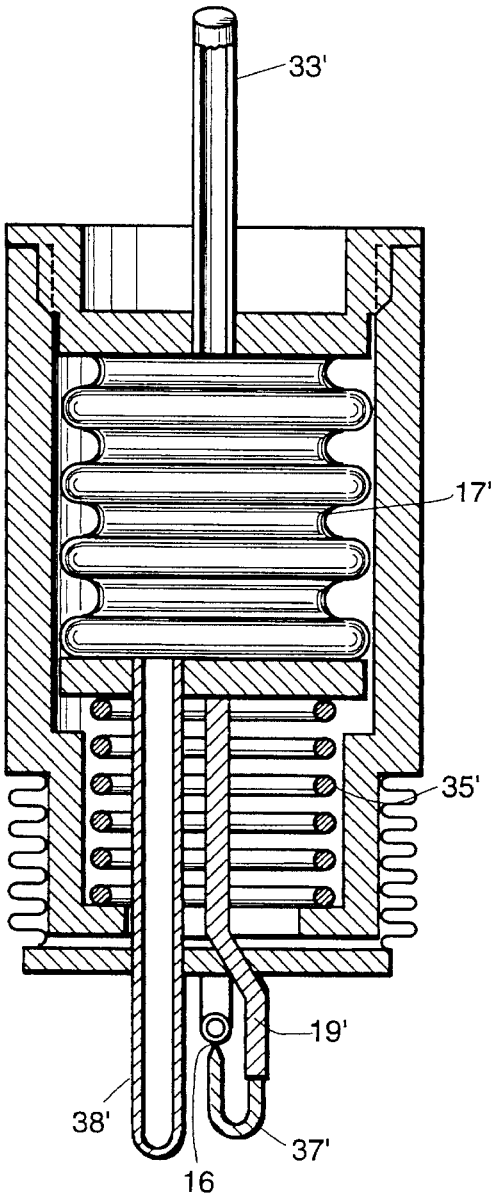
FIG. 3*b* is an expanded, cross-sectional, plan view (side) of the bellows thermostat and Joule-Thomson needle valve in the closed position.

FIG. 2 is a schematic diagram of the Joule-Thomson cryostat 10' of the present invention. As shown in FIG. 2, the cryostat 10' is connected through a gas inlet fitting 1' to a coolant reservoir such as a portable, refillable gas tank, or bottle, supply 21'. A gas supply line 23' connecting the supply 21' to the inlet fitting 1' has a flow control device, such as a two-way, controllable, on-off valve 25'. Cooling is initiated by opening on-off valve 25', allowing gas from the supply 21' to flow through the supply line 23' and into the tubing 4' of the heat exchanger 3' in accordance with standard Joule-Thomson cryostat operation.

In a preferred embodiment of the present invention, coolant from the supply 21' is diverted for use within the bellows 17' and gas bulb 38'. A capillary gas supply line 27' connects the cryostat to the gas supply 21' through the on-off valve 25'. Downstream of the on-off valve 25', the capillary gas supply line 27' connects to a bellows valve 29'. In the preferred embodiment, the capillary gas supply line 27' leads next through a fixed pressure regulator valve 31' and into the bellows chamber via a gas line 33'. There is a minimum bellows pressure at which the bellows 17' is sufficiently contracted so as to completely shut off the needle valve 19'. Cooling ceases under this condition. The pressure regulator valve 31' is used to set the bellows charge pressure.

The bellows valve 29' is opened simultaneously with on-off valve 25', allowing the bellows chamber to fill with coolant from the same supply 21' as is being used to provide the cryostatic refrigeration. After an appropriate bellows chamber filling period, generally a matter of a few seconds, or as controlled by the pressure regulator valve 31', the bellows valve 29' is turned off. The cryostat then proceeds to operate in its traditional manner.

FIG. **3*a*** is an expanded, cross-sectional, plan view (side) of the bellows thermostat and Joule-Thomson needle valve in the open position.

FIG. **3*b*** is an expanded, cross-sectional, plan view (side) of the bellows thermostat and Joule-Thomson needle valve in the closed position.

As illustrated in FIGS. **3*a* and 3*b*, when the bellows is relatively warm, the gas pressure with the chamber is relatively high and the bellows is fully extended against a counter spring 35'. The needle 37' of the needle valve mechanism 19' is in its withdrawn position and the orifice 16' is wide open. As the cryostat coolant plenum chamber 28' and its heat load 15' cools, the gas within the bellows chamber similarly cools and the internal bellows gas pressure is reduced. At some temperature, depending on the coolant type, condensation takes place and the pressure follows the gas vapor pressure curve of the particular coolant in use. Near this point, the bellows gas pressure is sufficiently reduced so that the counter spring 35' compresses the bellows 17' and moves the needle 37' into the valve orifice 16'** cutting back on the gas flow. Gas flow and refrigeration are cut back, or cycled, until a bellows equilibrium temperature is reached, at which point the refrigeration equals the thermal load demand.

When the cooling cycle is over, the on-off valve 25' is closed and bellows valve 29' is reopened, providing the gas in the bellows chamber with an escape route. In the preferred embodiment, a return gas line 41', bridged in parallel with the pressure regulator valve 31', includes a check valve 43' and connects the bellows chamber back to the supply line 27'. As the counter spring 35' exerts force upon the bellows, residual gas from the bellows 17' bleeds into the supply line 27' and is vented through the heat exchanger 3' to the atmosphere at gas exit 13'.

The bellows 17' is substantially vacant and is therefore prepared for the next cool down cycle using the same or a new and different coolant from a new coolant supply 21'.

The present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. An apparatus for filling and bleeding a bellows in a Joule-Thomson cryostat system having a demand-flow Joule-Thomson cryostat connected to a coolant reservoir by a coolant supply line and a coupling for said coolant supply line to said reservoir including a controllable on-off device, said apparatus comprising:

means for diverting coolant from said coolant reservoir to and from said bellows and means for controlling flow of coolant to and from said bellows.

2. The apparatus as set forth in claim 1 wherein said means for diverting coolant comprises a second coolant supply line, connected at a first end downstream from said coupling and at a second end to said bellows.

3. The apparatus as set forth in claim 2 wherein said means for controlling flow of coolant further comprises a second controllable on-off valve within said second coolant supply line.

4. The apparatus as set forth in claim 3 wherein said means for controlling flow of coolant further comprises a pressure regulator for determining the pressure of the coolant within said bellows.

5. The apparatus as set forth in claim 4 wherein said pressure regulator further comprises:

a pressure regulator valve within said second coolant supply line downstream of said second controllable on-off valve and upstream of said bellows;

a by-pass supply line bridging said pressure regulator valve; and a check valve in said by-pass supply line adapted to allow bleeding of said coolant from said bellows after termination of a cryostatic cooling cycle.

6. In a thermal load cooling system, having an external, replaceable coolant reservoir, a Joule-Thomson cryostat having a bellows controlled coolant demand-flow needle valve, and a coolant supply line connecting said Joule-Thomson cryostat to said reservoir through a controllable on-off valve, a multiple coolant adaptable bellows apparatus comprising:

a supplemental coolant supply line, connected at one end to said reservoir downstream of said on-off valve, and at a second end to said bellows and a controllable bellows on-off valve in said supplemental coolant supply line, such that coolant from said reservoir is supplied to said bellows during a cooling cycle of operation and bled from said bellows after termination of said cooling cycle.

7. The apparatus of claim 6 further comprising: a controllable check valve in said supplemental coolant supply line connected between said bellows on-off valve and said bellows;

a by-pass coolant supply line bridging said controllable check valve and a pressure regulator valve connected in said by-pass coolant supply line, whereby coolant pressure within said bellows is controlled by said pressure regulator valve.

8. A method for adapting a bellows thermostat device in a Joule-Thomson cryostat to use with a variety of coolants from a replaceable reservoir of coolant, comprising the steps of:

coupling said bellows thermostat device to said reservoir during a cooling cycle;

filling said bellows with coolant from said reservoir; and after termination of said cooling cycle, bleeding said coolant from said bellows, whereby said bellows is prepared for adaptive use with a different coolant.

9. The method as set forth in claim 8 further comprising the step of controlling the pressure level of coolant within said bellows during said step of filling said bellows.

10. An adaptable multiple coolant bellows control device for a Joule-Thomson cryostat having an external, replaceable coolant reservoir, a cryostat bellows controlled thermostat, and a coolant supply line having an integral first controllable on-off valve, connecting said reservoir to said cryostat at a cryostat gas inlet fitting, said control device comprising:

a secondary capillary coolant supply line having a first end connected to said coolant supply line downstream of said first controllable on-off valve and a second end connected to said cryostat bellows;

a secondary, two-way, controllable on-off valve within said secondary capillary coolant supply line upstream of said cryostat bellows for providing coolant flow to and from said chamber;

a pressure regulator valve within said secondary capillary coolant supply line downstream of said secondary controllable on-off valve and upstream of said chamber; and a one-way check valve, connected within said secondary capillary coolant supply line bridging said pressure regulator valve in parallel, adapted to allow coolant to bleed from said chamber when said first controllable on-off valve is off.

* * * * *